United States Patent [19]

Manzo

[11] Patent Number: 4,886,245

[45] Date of Patent: Dec. 12, 1989

[54] INTERLOCKING PIVOT DEVICE FOR ADJUSTABLE BALLUSTERS

[76] Inventor: Louis Manzo, 8 Putnam Ct., Holmdel, N.J. 07733

[21] Appl. No.: 168,636

[22] Filed: Mar. 3, 1988

Related U.S. Application Data

[63] Continuation-in-part of Ser. No. 6,292, Jan. 20, 1987, abandoned, which is a continuation-in-part of Ser. No. 861,367, May 9, 1986, abandoned.

[51] Int. Cl.[4] ..... E04H 17/14

[52] U.S. Cl. ..... 256/67; 256/65; 403/79

[58] Field of Search ..... 256/67, 65, 60; 403/79, 403/157, 158, 91, 73; 16/383; 52/184, 183

[56] References Cited

U.S. PATENT DOCUMENTS

| | | | |
|---|---|---|---|
| 2,177,202 | 10/1939 | Berge | 403/73 |
| 3,004,751 | 10/1961 | Woodward | 256/67 |
| 3,137,899 | 6/1964 | Troutner . | |
| 3,475,042 | 10/1969 | Speers et al. | 403/91 |
| 3,805,327 | 4/1974 | Walker | 16/383 |
| 4,236,848 | 12/1980 | Rock et al. . | |
| 4,344,604 | 8/1982 | Basey . | |
| 4,352,485 | 10/1982 | Basey . | |
| 4,403,767 | 9/1983 | Basey . | |
| 4,408,749 | 10/1983 | Zieg | 256/67 |
| 4,421,302 | 12/1983 | Grimm et al. . | |
| 4,533,121 | 8/1985 | Basey . | |

FOREIGN PATENT DOCUMENTS

| | | | |
|---|---|---|---|
| 187123 | 7/1907 | Fed. Rep. of Germany | 403/157 |
| 2244055 | 3/1974 | Fed. Rep. of Germany | 52/184 |

*Primary Examiner*—Andrew V. Kundrat

*Attorney, Agent, or Firm*—Gottlieb, Rackman & Reisman

[57] ABSTRACT

A two-piece interlocking pivot device for pivotably connecting a balluster to a hand or foot rail of a staircase assembly is provided. The pivot device includes a disk-like element and an enclosure element which receives the disk-like element in order that the latter is slidably pivotable within the enclosure element.

41 Claims, 4 Drawing Sheets

FIG. 3
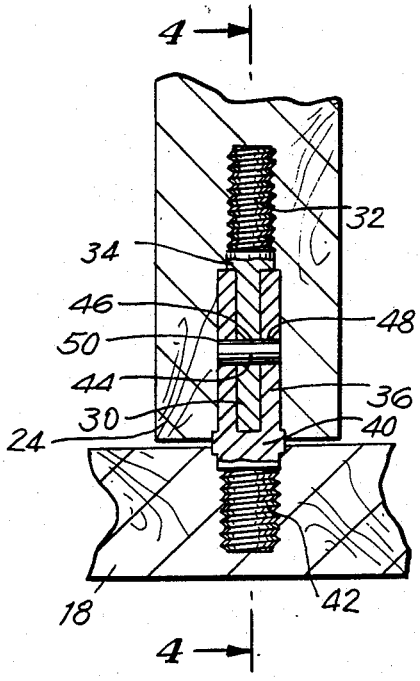
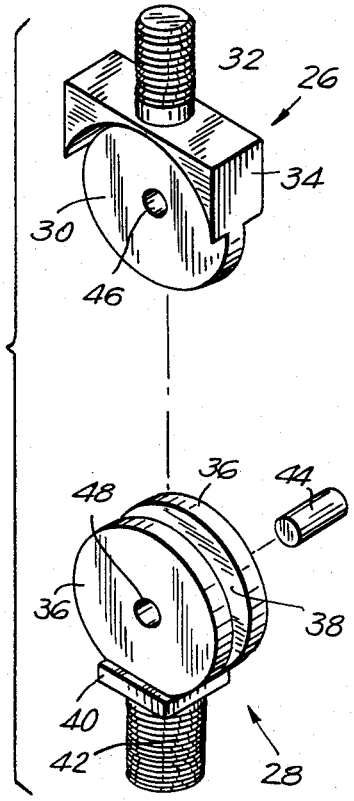
FIG. 2
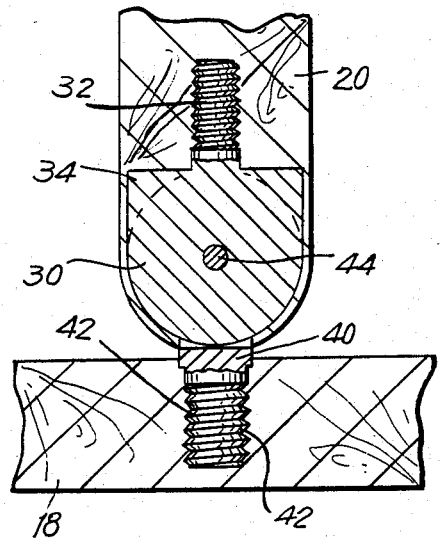
FIG. 4

FIG. 8
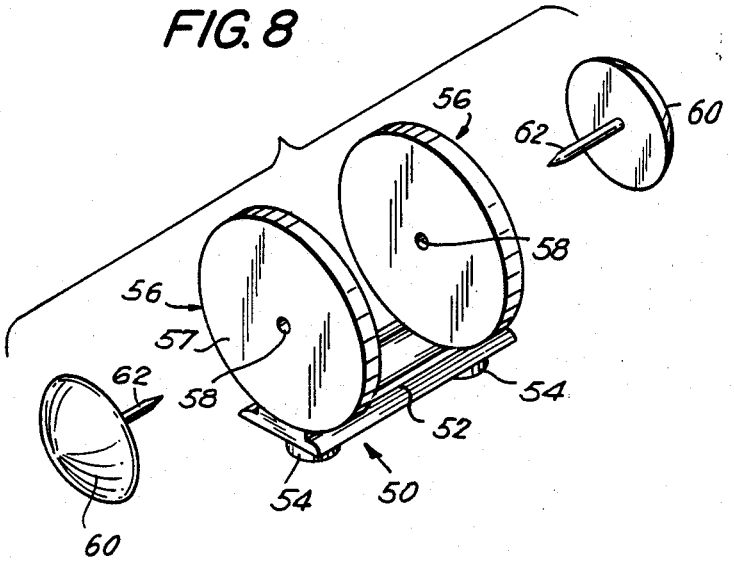
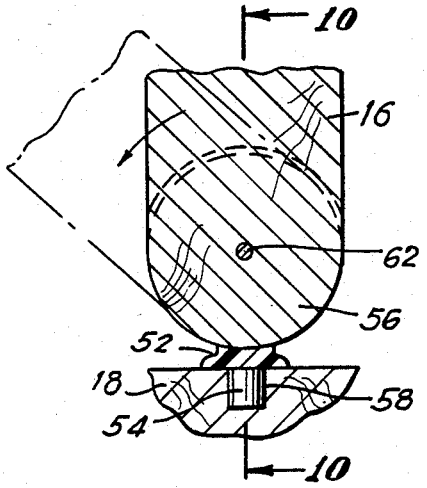
FIG. 9
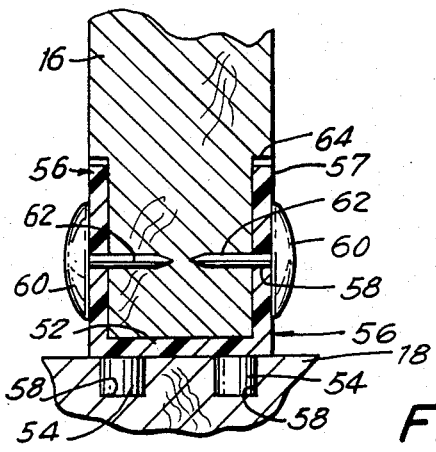
FIG. 10

INTERLOCKING PIVOT DEVICE FOR ADJUSTABLE BALLUSTERS

This application is a continuation-in-part of application Ser. No. 006,292, filed Jan. 20, 1987, now abandoned, which is a continuation-in-part of Ser. No. 861,367, filed on May 9, 1986, now abandoned.

BACKGROUND OF THE INVENTION

This invention relates generally to a two-piece pivot device for adjustable ballusters and the like, and, more particularly, to a two-piece interlocking pivot device for pivotably connecting a balluster to a hand or foot rail of a staircase assembly.

In both contemporary and traditional architecture, it is quite fashionable to install a decorative stair rail assembly. Such assemblies include upper and lower rail portions which traverse the length of the assembly between two end posts and a plurality of ballusters which extend vertically between the upper and lower rail portions at longitudinally spaced intervals. The construction of such a staircase assembly requires the exercise of a great deal of skill and care, particularly since the angle between each balluster and the rail portions will vary with the pitch or degree of rise of the staircase or other surface with which the assembly is associated. Most difficult is to properly position the ballusters in precise vertically extending relation along the incline portion of the staircase once the rail portions have been cut and positioned between the posts.

One solution to this problem has been a type of universal assembly which permits installation of the staircase assembly with any appropriate angle between the ballusters and the upper and lower rail portions. However, since the assembly pivots together and is in actuality an overall fixed assembly, installation still requires a great deal of skill and care, and therefore the assembly is less than desirable.

Another solution was to provide recesses including clearances in the rails for permitting deflection of the balluster from a normal inclination. However, this approach was also disadvantageous since the balluster may slide within the recess after installation.

Accordingly, it is desirable to provide an improved method for pivotably connecting a balluster to a hand or foot rail that overcomes these problems.

BRIEF SUMMARY OF THE INVENTION

Generally speaking, in accordance with the invention, a two-piece interlocking pivot device for pivotably connecting a balluster to a hand or foot rail of a staircase assembly is provided. The pivot device includes a disk-like element with a first connector integrally formed therewith and an enclosure element having a slotted opening for receiving the disk-like element and a second connector formed integrally therewith. The disk-like element is slidably pivotable within the enclosure element in order to achieve a full range of pivoting angles.

Preferably, the two connectors of the device are formed as threaded cylindrical mounting screws. This allows the connectors to be easily secured within the balluster or rail of the staircase assembly. In an alternative embodiment, the pivot device includes an enclosure element for receiving the balluster and formed with a rail connector, and a pair of cap members covering the enclosure element and formed with a balluster connector. The enclosure element is rotatably pivotable with respect to the cap members in order to achieve a full range of pivoting angles.

Accordingly, it is an object of the invention to provide an improved means for pivotably connecting a balluster to a hand or foot rail of a staircase assembly.

Yet another object of the invention is to provide an interlocking pivot device which is used for pivotably connecting a balluster to a hand or foot rail.

It is still a further object of the invention to provide a pivot device which includes a male member and a female member.

Still another object of the invention is to provide a device for pivotably connecting a balluster to a hand or foot rail which is of an uncomplicated construction and which may be readily and quickly installed by an unskilled person.

Still other objects and advantages of the invention will, in part, be apparent from the specification when considered in conjunction with the drawings and claims hereof.

The invention accordingly comprises the device embodying the features of construction, combination of elements, and arrangement of parts as exemplified in the following detailed disclosure, and the scope of the invention will be indicated in the claims.

DESCRIPTION OF THE DRAWINGS

For a fuller understanding of the invention, reference is made to the following description taken in connection with the accompanying drawings, in which:

FIG. 2 is an exploded perspective view of the pivot device in accordance with the invention;

FIG. 3 is a sectional view taken along line 3—3 of FIG. 1;

FIG. 4 is a sectional view taken along line 4—4 of FIG. 3;

FIG. 8 is an exploded perspective view of a second embodiment of the pivot device in accordance with the invention;

FIG. 9 is a sectional view of the pivot device in FIG. 8 shown pivotally connecting a balluster to a foot rail of a staircase assembly; and FIG. 10 is a sectional view taken along line 10—10 of FIG. 9.

DESCRIPTION OF THE PREFERRED EMBODIMENT

Figure 1:
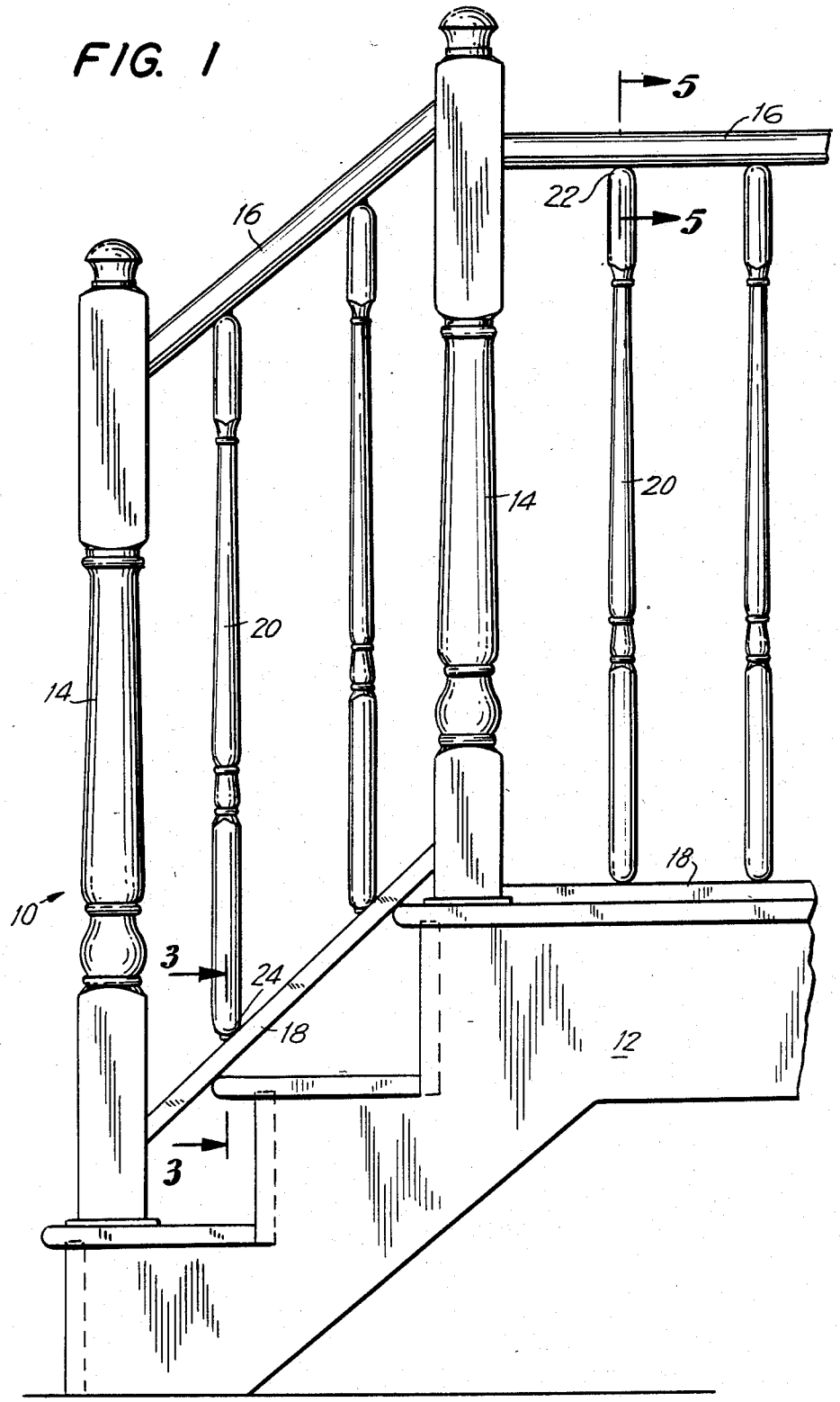
FIG. 1 is a side elevational view of a staircase assembly employing the pivot device of the invention.

Referring now to the drawings, a two-piece interlocking pivot device in accordance with the invention is disclosed. As illustrated in FIG. 1, the pivot device of the invention is employed in a stairway system generally designated at 10. The stairway system includes a tread and riser assembly 12 defining multiple stairway landings. The stairway system is mounted between a vertically extending newel post 14 fixedly mounted to the tread and riser assembly 12. The system 10 includes slanted, longitudinally extending top rails 16 and correspondingly slanted longitudinally extending bottom rails 18. A plurality of ballusters 20 extend in spaced parallel relation between the top and bottom longitudinal rails 16 and 18. The ballusters have top ends 22 and bottom ends 24 joining respectively with top rails 16 and bottom rails 18. At top ends 22 and bottom ends 24, the two-piece interlocking pivot device in accordance with the invention is provided for pivotably connecting ballusters 20 to top rails 16 and bottom rails 18.

Turning to FIG. 2, the two-piece interlocking pivot device of the invention is shown. The device includes a male element generally designated at 26 and a female element generally designated at 28. Male element 26 includes a disk 30 and a housing 34 integrally formed therewith which extends about halfway along the circumference of disk 30. Male element 26 also includes a cylindrical threaded member 32 extending upward from housing 34. Female element 28 includes spaced, parallel disks 36, thereby forming a slotted opening 38 for receiving disk 30 of male element 26. Element 28 further includes a base 40 on which disks 36 are mounted and a cylindrical threaded member 42 disposed beneath base 40. In assembly, after disk 30 of male element 26 is inserted in slotted opening 38 of female element 28, a pin 44 is inserted through aligned bores 48 of disks 36 and bore 46 of disk 30 in order to pivotably engage elements 26 and 28.

Figure 6:
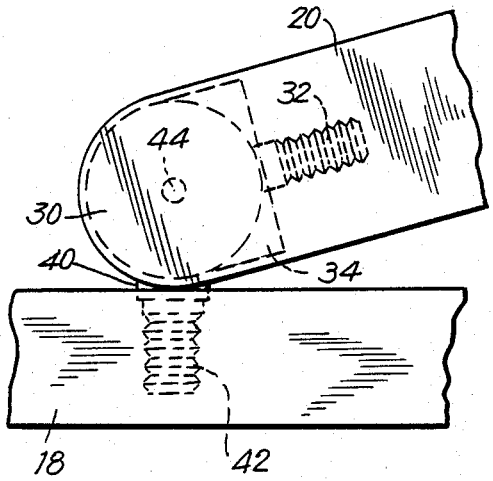
FIG. 6 is a sectional view of the pivot device in accordance with the invention showing the disk element slidably pivoting within the enclosure element.

Turning now to FIGS. 3 and 4, the pivot device in accordance with the invention is shown connecting bottom rail 18 to balluster 20. In order to pivotably connect balluster 20 to bottom rail 18, a recess 50 is formed in bottom end 24. Then, the pivot device is inserted in recess 50, with threaded member 32 being force fit into balluster 20 in order to anchor the device in the balluster. Then, threaded member 42 which extends past bottom end 24 of balluster 20, is force fit into bottom rail 18 in order to anchor the device therein. After connecting the balluster and bottom rail by means of the device, the balluster 20 may pivot at a full range of pivoting angles, as best shown in FIG. 6. This is because disk 30 of male element 26 is mounted for slidable pivoting movement within disks 36 of element 28 by means of pin 44. Consequently, male element 26 will freely rotate about pivot pin 44 so that balluster 20 may be adjusted to various angles with respect to bottom rail 18 in order to accommodate various stair slopes.

Figure 5:
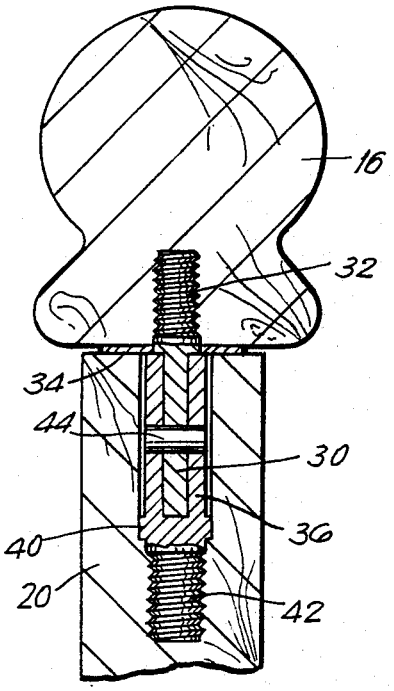
FIG. 5 is a sectional view taken along line 5—5 of FIG. 1.

Reference is now made to FIG. 5 which illustrates the two-piece interlocking pivot device when pivotably connecting balluster 20 to handrail 16. Like the pivot device which connected the balluster to the foot rail, the pivot device shown in FIG. 5 is made from slidably coupled elements including disk 30, cover 34, and threaded member 32, and an enclosure receptacle including disks 36, base 40, and threaded member 42. It is noted that cover 34 extends transversely with respect to disks 30 and 36, projecting a distance beyond the width of the device on either side in order to better stabilize the balluster-handrail connection.

Figure 7:
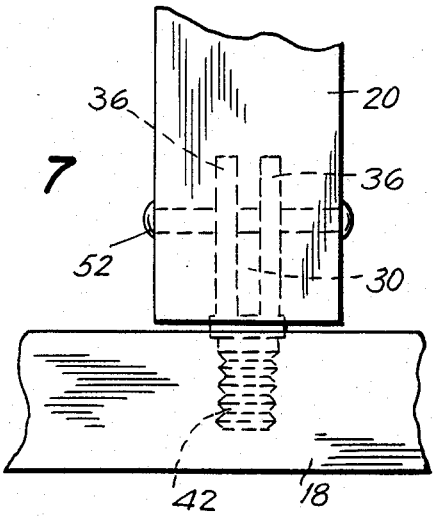
FIG. 7 is a sectional view of an alternative embodiment of the pivot device in accordance with the invention in which a pin extends through the device.

FIG. 7 shows an alternative embodiment of the pivot device of the invention, having a pin 52 extending through disks 30 and 36 after balluster 20 is connected to foot rail 18. Since pin 52 is positioned through the entire width of balluster 20, a reinforced connection between balluster 20 and foot rail 18 is provided, thereby giving more security in particular installations.

Although the male element and the female element of the preferred embodiment include substantially circular disks which mate in order to form a substantially circular pivot device, those elements may be appropriately shaped in order to form a device of varying appearance, with the disks being correspondingly configured, so long as the device exhibits the necessary characteristics for carrying out the invention.

Turning now to FIG. 8, a three-piece interlocking pivot device in accordance with the invention is shown. The device includes a female element generally designated at 50, which comprises spaced parallel disks 56, a base member 52 on which the disks are mounted and a pair of peg members 54 integrally formed with the base member 52 and extending away from disks 56. Disks 56 include respective outer surfaces 57 and central bores 58. The device also includes two cap members 60 of a generally hemispherical shape having pins 62 extending therefrom. In assembly, pins 62 of cap members 60 are fitted through bores 58 formed in disks 56 in order that cap members 60 are coveringly positioned adjacent outer surfaces 57 of disks 56.

In FIGS. 9 and 10, the pivot device of FIG. 7 is shown operatively connecting bottom rail 18 to balluster 16 of a conventional stairway system. In order to pivotally connect balluster 16 to bottom rail 18, rail 18 is formed with a pair of receiving holes 58 in which pegs 54 of female element 50 are inserted and anchored. Then, the disks 56 of female element 50 are inserted within exterior grooves 64 of balluster 16. Since grooves 64 are slightly larger than disks 56, disks 56 rotate freely within grooves 64. Once disks 56 are appropriately positioned, cap members 60 are coveringly positioned over the outer surfaces 57 of disk members 56 by inserting pins 62 through holes 58 of disk members 56 and then screw-fitting them into balluster 16 in order to anchor the pivot device therein. As a result, balluster 16 may pivot through a full range of pivoting angles, as best shown in FIG. 9. This is because cap members 60 can rotate freely with respect to disks 56 when balluster 16 is adjusted to various angles with respect to bottom rail 18 during staircase assembly.

It will thus be seen that the object set forth above, among those made apparent from the preceding description, are efficiently attained and, since certain changes may be made in the above construction, without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An interlocking pivot device for pivotally connecting the end of a balluster to a hand or foot rail of a staircase assembly, comprising:

a female element mounted in said balluster end and having a slotted opening;

a male member, said slotted opening of said female element receiving and mating with said male member, said male member pivotally rotating within said female element;

first means for connecting one of said male member and said female element to said balluster;

second means for connecting the other of male member and said female element to said hand or foot rail;

wherein said female element and mated male member are received in a slot formed in said balluster end.

2. The pivot device of claim 1, wherein said first connector means connects said male member to said balluster, said second connector means connects said female element to said rail.

3. The pivot device of claim 1, wherein said first and second connector means comprise first and second threaded means.

4. The pivot device of claim 1, wherein the arc of the pivotable movement of said male element within said female element is defined by pin means journaled through said elements.

5. The pivot device of claim 1, wherein said male element includes a first disk member and wherein said female element includes second and third disk members, said slotted opening being defined between said second and third disk members for receiving said first disk member, said first disk member being slidably pivotable with respect to said second and third disk members.

6. The device of claim 5, wherein said first disk member is slidably pivotable with respect to said second and third disk members by a pin means journaled through said disk members.

7. The device of claim 6, wherein said pin means has a first end and a second end, said first and second ends extending beyond said disk members, whereby said pin means is positioned through the entire width of said balluster.

8. An interlocking pivot device for pivotally connecting the end of a balluster to a hand or foot rail of a staircase assembly, comprising:

a female element rotatably mounted over said balluster end and having a slotted opening;

coupling means connected to and freely pivotable with respect to said female element;

first means for connecting one of said female element and said coupling means to said balluster; and second means for connecting the other of said female element and said coupling means to said hand or foot rail.

9. The pivot device of claim 8, wherein said female element includes first and second disk members, said slotted opening defined between said disk members for receiving the end of said balluster.

10. The pivot device of claim 9, wherein said coupling means comprises cap members coveringly positioned adjacent the outer surface of said disk members.

11. The pivot device of claim 10, wherein said first connecting means comprises means for connecting said coupling means to said balluster.

12. The pivot device of claim 11, wherein said first connecting means comprises pin members extending from said cap members.

13. The pivot device of claim 12, wherein said disk members include bores formed therethrough for receiving said pin members.

14. The pivot device of claim 12, wherein said pin members are screw fitted in said balluster end.

15. The pivot device of claim 10, wherein said second connecting means comprises means for connecting said female element to said rail.

16. The pivot device of claim 15, wherein said second connecting means comprises at least one peg member extending from said female element.

17. A method for pivotally connecting the end of a balluster to a hand or foot rail of a staircase assembly comprising:

affixing a female element in said balluster end;

pivotally connecting a coupling means to said female element; and connecting said female element and said pivotally connected coupling means to said hand or foot rail.

18. The method of claim 17, wherein said balluster end connecting step comprises connecting said female element to said balluster end and said rail connecting step comprises connecting said coupling means to said rail.

19. The method of claim 18, wherein said affixing step comprises receiving first and second disk members of said female element within said balluster end.

20. The method of claim 19, wherein said pivotally connecting step comprises receivably mating a male member of said coupling means with said female element.

21. The method of claim 20, wherein said connecting steps comprise screwing at least one threaded means extending from said female element into said balluster end and screwing at least one threaded means extending from said male member into said rail.

22. The method of claim 18, wherein said mounting step comprises receiving said balluster end within first and second disk members of said female element.

23. The method of claim 22, wherein said pivotally connecting step comprises coveringly positioning cap members of said coupling means adjacent the outer surface of said female element disk members.

24. The method of claim 23, wherein said balluster end connecting step comprises screw-fitting pin members extending from said cap members in said balluster end.

25. The method of claim 23, wherein said rail connecting step comprises anchoring at least one peg member extending from said female element in said hand or foot rail.

26. A staircase assembly comprising:

a hand and a foot rail; at least one balluster; and an interlocking pivot device for pivotally connecting the end of a balluster to said hand and foot rail, said device including a female element mounted in said balluster end and having a slotted opening, said slotted opening receiving and mating with a male member which pivotally rotates within said female element, first means for connecting one of said male member and said female element to said balluster, second means for connecting the other of said male member and said female element to said hand or foot rail; wherein said female element and said mated male member are received in a slot formed in the balluster end.

27. The assembly, of claim 26, wherein said first connecting means connects said male member to said balluster, said second connecting means connects said female element to said rail.

28. The assembly, of claim 26, wherein said first and second connecting means comprise first and second threaded means.

29. The assembly, of claim 26, wherein the arc of the pivotable movement of said male element within said female element is defined by pin means journaled through said elements.

30. The assembly, of claim 26, wherein said male element includes a first disk member and wherein said female element includes second and third disk members, said slotted opening being defined between said second and third disk members for receiving said first disk member, said first disk member being slidably pivotable with respect to said second and third disk members.

31. The assembly of claim 30, wherein said first disk member is slidably pivotable with respect to said second and third disk members by a pin means journaled through said disk members.

32. A staircase assembly comprising:

a hand rail and a foot rail;

at least one balluster; and an interlocking pivot device for pivotally connecting the ends of said balluster to said hand and foot rail, said pivot device including a female element rotatably mounted over said balluster end and having a slotted opening, coupling means connected to and freely pivotable with respect to said female element, first means for connecting one of said female element and said coupling means to said balluster, and second means for connecting the other of said female element and said coupling means to said hand or foot rail.

33. The assembly of claim 32, wherein said female element includes first and second disk members, said slotted opening defined between said disk members for receiving the end of said balluster.

34. The assembly of claim 33, wherein said coupling means comprises cap members coveringly positioned adjacent the outer surface of said disk members.

35. The assembly of claim 34, wherein said first connecting means comprises means for connecting said coupling means to said balluster.

36. The assembly of claim 35, wherein said first connecting means comprises pin members extending from said cap members.

37. The assembly of claim 36, wherein said disk members include bores formed therethrough for receiving said pin members.

38. The assembly of claim 36, wherein said pin members are screw fitted in said balluster end.

39. The assembly of claim 34, wherein said second connecting means comprises means for connecting said female element to said rail.

40. The assembly of claim 39, wherein said second connecting means comprises at least one peg member extending from said female element.

41. The method of claim 17, wherein said affixing step comprises rotatably coupling said female element to said balluster end.

* * * * *